United States Patent [19]

Biermann et al.

[11] 4,268,063

[45] May 19, 1981

[54] CROSS COUNTRY SKI BINDING

[75] Inventors: Peter Biermann, Leonberg; Rudi Feucht, Weissach; Manfred Schmidt, Sindelfingen, all of Fed. Rep. of Germany

[73] Assignee: Vereinigte Baubeschlagfabriken Gretsch and Co. GmbH, Leonberg, Fed. Rep. of Germany

[21] Appl. No.: 931,539

[22] Filed: Aug. 7, 1978

[30] Foreign Application Priority Data

Aug. 5, 1977 [DE] Fed. Rep. of Germany ..... 2735489

[51] Int. Cl.[3] ..... A63C 9/18

[52] U.S. Cl. ..... 280/615

[58] Field of Search ..... 280/615, 614, 635, 611, 280/632, 631, 626

[56] References Cited

U.S. PATENT DOCUMENTS

| | | | |
|---|---|---|---|
| 2,172,669 | 9/1939 | Taft | 280/614 |
| 3,386,748 | 6/1968 | Eie | 280/615 |
| 3,675,937 | 7/1972 | Laszlo | 280/626 |
| 4,082,312 | 4/1978 | Johnson | 280/615 |
| 4,108,467 | 8/1978 | Kreyenbuhl | 280/615 |
| 4,129,319 | 12/1978 | Strohmeier | 280/615 |

FOREIGN PATENT DOCUMENTS

| | | | |
|---|---|---|---|
| 2610041 | 10/1976 | Fed. Rep. of Germany | 280/615 |
| 2721976 | 5/1978 | Fed. Rep. of Germany | 280/615 |
| 348634 | 5/1931 | United Kingdom | 280/615 |

*Primary Examiner*—John J. Love
*Assistant Examiner*—Milton L. Smith
*Attorney, Agent, or Firm*—Craig and Antonelli

[57] ABSTRACT

A cross country ski binding of the type in which a forwardly extended portion of the sole of a ski shoe is received by and fixed into a chamber fitted to the ski. In the present arrangement an over center linkage is arranged generally in front of the chamber and includes a clamp portion with a hooked end which fits over the top of the chamber and engages an abutment on the upper side of the extended sole portion so that on engaging the binding by actuation of the over center linkage the hook is pulled forwardly to secure the ski shoe within the binding. An especial feature of the arrangement is that the clamp is arranged as a resilient spring which obviates the need for resilience elsewhere in the binding. Actuating means are provided which allow the skier to open and close the binding from a standing position with a ski pole. In a modification an auxiliary spring fastened to the clamp is used to assist disengagement of the hooked end of the clamp.

22 Claims, 5 Drawing Figures

CROSS COUNTRY SKI BINDING

Figure 1:
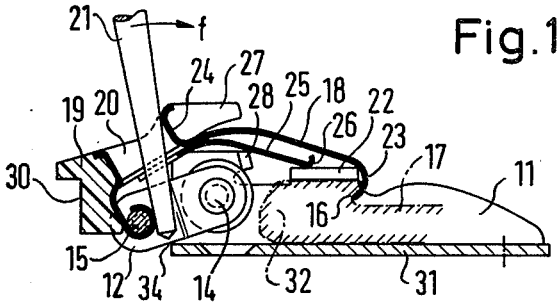

This invention relates to a cross country ski binding and has particular reference to a ski binding having two side plates and a top restraint for locating the forward part of the sole of the ski shoe and which incorporates a forwardly located overcenter lever mechanism to tension a clamp incorporating a hooked end against an abutment on the sole of the ski shoe. A cross country ski binding of this type is primarily used for securing cross country ski shoes of the type having a forward extension of the sole which engages a preferably rectangular shaped chamber of the binding. In this type of binding the upper part of the chamber is formed by a top restraint wall and two side plates are provided which diverge rearwardly and outwardly alongside the forward part of the sole of the ski shoe. The side plates can either run divergingly rearwardly from the forward end of the chamber or can have forward portions which lie parallel to one another in the vicinity of the chamber and subsequently diverge conically outwardly rearwardly of this chamber.

In a known binding e.g. such as is shown in DT-OS 2 610 041 the side plates extend rearwardly generally over the forward part of the sole of the ski shoe while the top restraint is limited to extending rearwardly over the extension of the sole of the ski shoe to a position which leaves a distinct clearance between the rear border of the top restraint and the upper of the ski shoe. This is necessary in order to avoid contact of the shoe upper on the binding during lifting of the ski shoe. In this way a smooth upward rolling movement of the ski shoe and sole is made possible during cross country skiing without disadvantageously affecting the secure location of the ski shoe to the ski.

The fastening of the extension of the sole of the ski shoe is, however, relatively awkward in the known ski binding. This is either achieved by means of a vertically arranged screw which engages the forward extension of the ski sole or by means of holding pins inserted sideways through the side plates and the forward extension of the sole of the ski shoe.

The object of the present invention is to provide a cross country ski binding of the type previously mentioned which is exceptionally compactly constructed and is convenient and comfortable to fasten and unfasten while simultaneously enabling the ski shoe to be secured to the ski without problem and without restricting or impeding the movement of the sole of the ski shoe during cross country skiing. Additionally the cross country ski binding of the invention should be relatively economical to manufacture and should be of relatively uncomplicated construction.

According to the present invention there is provided a cross country ski binding comprising a chamber open at at least one of its ends and having side plate means and top restraint means for receiving and locating in operation the front portion of the sole of a ski shoe, an over center linkage closure device disposed generally in front of said chamber and including a clamp connected by its one end to the over center pivot axis, the other end of said clamp being provided with hook means adapted to engage an abutment on the front portion of the sole of the ski shoe for securing said front portion in said chamber in the engaged position of the binding, the over center linkage further including link means pivotally connected to a pivot axis fixed relative to the binding and actuating means for engaging and releasing the binding by producing pivotal movement of the over center linkage about the said fixed pivot axis and wherein the said clamp comprises spring means elastically resilient in the direction of the forces prevailing during engagement of the binding. This construction allows the omission of special springs which would otherwise be required to hold the over center link in the closed or open positions. Because the cross country ski binding of the invention is arranged so that elements of the over center linkage overlap in the closed position it is possible, in accordance with a feature of the invention to arrange the actuating part for opening and closing the binding on the overlapping parts of the over center linkage without simultaneously giving rise to any significant relative increase in length as compared with known prior art bindings. Instead of an increase in length the binding is somewhat higher in the forward regions but this does not adversely affect but rather improves the apearance of the binding because the transition from the surface of the ski to the ski shoe takes place more steadily. An especially advantageous feature of the ski binding is that the impact of objects or snow on the over center link arrangement during skiing will not result in an undesired opening of the binding.

In accordance with a first and especially preferred embodiment of the invention the clamp is formed to be at least partially curved and elastically extensible. This clamp then extends over and covers practically all the movable parts of the binding. In order to usefully cover over the binding the spring clamp is conveniently and preferably made as a leaf spring which covers the entire binding.

It is especially advantageous for the actuating part for opening and closing the binding to be united with the clamp or alternatively to be formed as an integral part of the clamp.

In one preferred embodiment of this kind the actuating part is provided with an opening into which the tip of a ski pole can be inserted and this opening is arranged to lie generally above the over center pivot axis in the closed position of the binding. In this manner, and with the binding closed, the rear border of the aperture is preferably arranged to lie in general almost directly above the rear border of the over center pivot axis so that when the tip of a ski pole is inserted into the aperture it contacts both these borders and the ski pole will lie in a position inclined generally forwardly of the ski. This arrangement allows the ski binding to be readily opened by means of a skier pulling rearwardly on the grip of the ski pole so as to generate a torque in the opening direction to release the binding. Because of the long lever-arm provided by the ski pole even a relatively light pull on the ski pole will suffice to lift the over center link through its over center position, and once over this over center position the link will of its own accord snap into the open position.

In order to prevent the binding moving beyond the range of movement necessary to fully release the binding an abutment is provided which restricts the range of pivotal movement of the over center link in its open position. A significant feature of the invention is that the spring clamp is arranged so that all the stress in it is relieved prior to the linkage reaching the fully opened position defined by the abutment. In other words, in the reverse direction, during closing of the binding the tension in the clamp progressively increases during movement of the binding from the open to the closed position. This progressive increase is advantageous because the over center link is only called upon to overcome a small spring force in its fully open position while as it approaches the closed position in which its mechanical advantage is significantly increased it is better able to overcome the now considerably increased tension in the spring and thus to enable the binding to be closed i.e. for the over center link to move into its over center position without requiring undue effort from the skier. The significant spring tension which exists in the clamp at the over center point of the linkage is also effective in giving rise to a completely self-actuating opening movement once the over center linkage has been moved beyond its over center position.

Furthermore, because of the position of the aperture relative to the over center pivot axis the ski pole which in the closed position was forwardly inclined, will be slightly rearwardly inclined in the open position of the binding which is limited by the aforementioned abutment and in this way the ski pole can be readily withdrawn from the binding by the skier and the general arrangement of the parts of the binding means that there is no danger of the ski pole sticking within the binding and being difficult to withdraw. In this manner the skier only needs to execute movements within a space whose limits are all ergonomically readily accessible in order to operate the ski binding via the ski pole. One advantageous form of the invention, which can be used independently of any of the other previously mentioned characteristics of the invention, resides in the provision of an auxiliary spring fastened by its one end to the actuating part or the clamp and the other end of which bears either on a relatively fixed part of the binding or on the upper side of the sole of the ski shoe and which is likewise tensioned when the binding is in its closed position but is only relaxed when the binding is in its open position and the hooked end of the clamp has been lifted from the undercut abutment on the sole of the ski shoe i.e. has moved to at least the height of the top restraint of the binding. The auxiliary spring is usefully in the form of a leaf spring extending from the actuating part to the top restraint and preferably disposed beneath the clamp. The auxiliary spring ensures that the hooked end of the clamp is lifted from the abutment on the top side of the sole of the ski shoe when the binding is in its open position. It is basically possible to use other types of springs for this purpose e.g. a hair pin type spring arranged with its bend around the over center pivot axis.

The clamp is itself likewise preferably a leaf spring extending over the width of the binding, but could have other forms e.g. a wire loop for engaging the abutment on the ski shoe and which is connected to the over center linkage via coil springs.

In order to be able to close the binding in a simple manner with the ski pole an advantageous modification of the invention is the forming of a recess on the top of the actuating part into which the tip of the ski pole can be inserted and which is preferably located between the over center pivot axis and the hooked end. By this means the simple act of pressing downwardly on the ski pole enables the binding to be closed. Thus the ski binding can not only be opened but also closed by way of the ski pole so that there is no requirement for the skier to bend down.

Preferably the abutment for limiting the opening movement of the binding is so positioned that it restricts the opening movement to the point at which the hooked end of the clamp has just lifted free of the abutment on the upper surface of the sole of the ski shoe. In this manner it is ensured that when the ski shoe is inserted into the binding the hooked end is located directly above the undercut abutment on the sole of the ski shoe so that the initial closing movement of the binding is accompanied by movement of the hook into its engaged position and subsequent tensioning of the clamp during the closing movement.

In this way it will be seen that a device should be provided for limiting the opening movement in order to ensure a straightforward closure of the binding after insertion of the ski shoe.

The abutment for limiting the opening movement can conveniently be arranged to cooperate with the links of the over center arrangement. The links thus not only function as part of the over center linkage but rather they also form an element used to limit the range of movement of the over center linkage. In the closed position the movement of the over center link is preferably prevented by contact between the links and the base plate of the binding so that the links also limit the closure movement of the binding.

A further important feature of the invention is that the recess is trivially displaced rearwardly of the transverse axis of the linkage arrangement which is fixed relative to the ski. This has the result that on pressing downwardly with the tip of a ski pole only a small closing torque is initially generated so that the first effect of the pressure is to cause the hooked end to engage the abutment on the ski shoe and that it is only after this has occurred that the closure force on the binding results in the rotational movement of the over center linkage. In order to emphasize this effect it is useful to provide a frictional resistance which at least resists the closure movement. This frictional resistance can conveniently be provided by arranging a frictional member in the vicinity of the pivot points for the links. Care should also be taken to ensure, by the physical layout of the binding that when initially exerting low forces on the binding the links remain in contact with the opening abutments and the only movement which takes place is a pivotal movement of the actuating part and the clamp about the over center pivot axis until the hooked end of the clamp engages the abutment on the sole of the ski shoe. Only when this has occurred should increase of downward pressure on the link arrangement result in an initial closing movement of the over center link. In this connection it is, amongst other things, important that the rotational resistance about the over center pivot axis is less than the rotational resistance about the transverse axis fixed to the ski.

The auxiliary spring is usefully formed to be sufficiently weak that it only generates enough force to lift the relaxed clamp from the abutment when the binding is in the open position. Thus the necessary opening force after lifting the over center link through its over center position is in general only supplied by the clamp and not from the auxiliary spring.

A specially simple embodiment of the invention is characterized by the provision of an operating part in the form of a strap attached to the binding in the vicinity of the over center link. In addition an aperture can be provided in the clamp itself in the vicinity of the over center pivot link into which the ski pole can be inserted. Thus the binding is opened by pulling on the strap while it can be closed either by inserting the ski pole into the aperture or by simply pressing on the clamp by hand.

Figure 2:
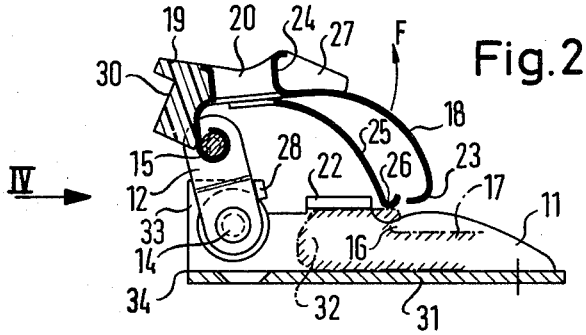
Figure 3:
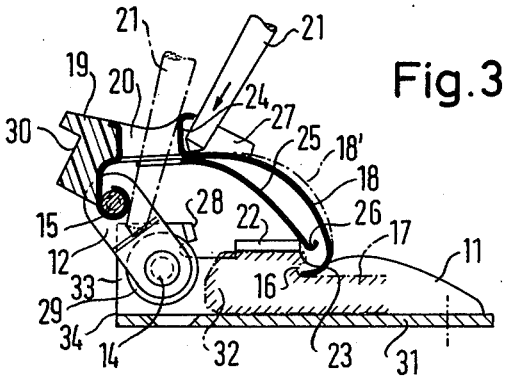
Figure 4:
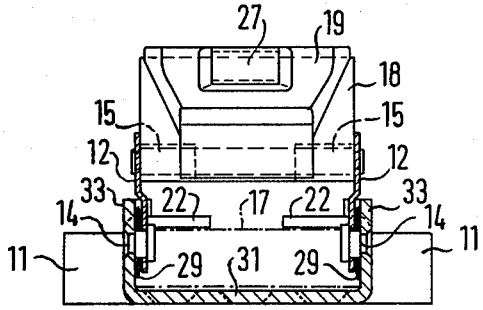
Figure 5:
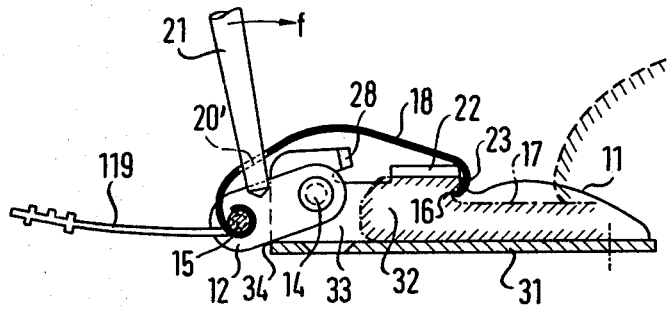

The invention will now be described by way of example only and with reference to the accompanying drawings in which are shown:

FIG. 1 a partially sectioned schematic side view of a cross country ski binding shown in the closed position with the tip of a ski pole inserted into the binding for the purpose of releasing it, FIG. 2 a view similar to FIG. 1 but showing the cross country ski binding in the fully released position, FIG. 3 a view similar to FIG. 1 and 2 but showing the cross country ski binding in an intermediate position such as occurs during either opening or closing movement of the ski binding, FIG. 4 a partly sectioned view of the subject of FIG. 2 as seen in the direction of the arrow IV and FIG. 5 a view similar to FIG. 1 of a simplified embodiment.

As seen in the drawings of FIG. 1 to 4 the ski binding basically comprises a base plate 31 which in use would be fastened to the top surface of the ski and two side plates 11 generally vertically upstanding from the base plate 31. At their forward ends the side plates extend generally parallel to the longitudinal axis of the ski and diverge outwardly in a rearward direction to approximately the side edges of the ski. The rear parts of the forward parallel portions of the two side plates are turned inwardly to face each other so as to form two restraints 22 which together with the side plates 11 and the base plate 31 form a generally rectangular chamber for receiving the forward extension 17 of the sole of a ski shoe. In the present case the two inner edges of the restraints 22 do not quite meet so that there is a space between them. The forward end of the extension of the sole of the ski shoe 17 is of greater thickness over the portion referenced 32. The portion 32 is chosen to fit exactly between the base plate 31 and the top restraint 22 so that the sole of the ski shoe is vertically accurately located at this point. The side plates 11 match the side profile of the sole of the ski shoe or at least of the forward part thereof so that at this region the ski shoe is also accurately located sideways without problem.

Because of the enlarged portion 32 of the forward part of the sole of the ski shoe an abutment step 16 exists which can be formed with a rearwardly disposed undercut in the manner illustrated which can then be used for the engagement of the hooked end 23 of a clamp 18. The undercut step effectively prevents the hooked end 23 slipping out of position when the binding is closed.

The forward continuations of the side plates 11 are used to form two trunnion mountings 33 to which a pair of respective links 12 are pivotally mounted about pivots 14 aligned along a common transverse axis. A pair of dished plate springs 29 are interposed one between each link and its respective trunnion mounting and operate to generate friction so as to prevent the links 12 from being too easily moved about the transverse axis 14 which is fixedly located relative to the ski.

The ends of the links 12 remote from the transverse axis 14 are connected together by a transverse pin 15 to which the front ends of a clamp 18 are pivotally connected. The end of this clamp 18 remote from the pivot axis 15 carries the hook 23 which is engageable with the undercut in the forward part of the sole of the ski shoe. The range of pivotal movement of the links 12 about the fixed pivot axis 14 and the position of the undercut are so chosen that the link 12 can be locked in a closed position by overcenter action as illustrated in FIG. 1. The arrangement is thus an overcenter device. Fixedly connected to the clamp 18 is an actuating part 19 which in the closed position of FIG. 1 extends rearwardly from a region just in front of the pivot pin 15 to approximately the position of the transverse axis 14 which is fixed relative to the ski. The actuating part 19 has an aperture 20 which in the closed position of the binding lies in general above the axis of the pin 15. In this closed position the forward wall 30 of the actuating part 19 stands generally at right angles to the top surface of the ski so that contact with objects or snow during use of the ski will not result in an undesired opening of the binding. The pivot pin 15 is referred to as the over center pivot axis as it moves "over" the fixed centerline formed by the fixed pivot 14 and the abutment step 16. Over center linkages are sometimes referred to as toggle linkages.

The clamp 18 is made from spring steel which is so formed that it defines the border around the opening 20 and protects the binding against damage during opening and closing thereof.

An auxiliary spring 25 is arranged beneath the clamp 18 and in the closed position of the binding extends generally rearwardly from the aperture 20 to the top surface of the top restraint 22 on which it bears.

In a modification not shown two auxiliary springs 25 can be arranged alongside one another.

A recess 27 is formed in the top surface of the actuating part 19 directly behind the opening 20 which is likewise provided for the insertion of the tip 21 of a ski pole.

The upper rearward edges of the trunnion mountings 33 are provided with inwardly turned abutments 28 which limit the clockesie or opening movement of the links 12.

The operation of the cross country ski binding of the invention is as follows:

In the closed position shown in FIG. 1 the hooked end of the clamp passes around the rear end of the top restraint 22 and engages in the undercut abutment 16 on the extension of the sole of the ski shoe. The end 26 of the auxiliary spring 25 bears on the forward portion of the top restraint 22. Both springs are tensioned. Because the axis of the pin 15 is located below the line joining the transverse axis 14 to the undercut abutment 16 the overcenter closure is in its locked position. The spring 18 holds the links 12 in abutment against the front edge 34 of the base plate 31. The transverse axis 14 must, therefore, be positioned above the closed position of the transverse pin 15 to enable the closed position to be maintained.

If it is desired to open the binding then, as shown in FIG. 1 a ski pole is inserted from above into the opening 20 and inclined slightly forwardly so that the tip of the ski pole 21 contacts the rear border 24 of the opening and also the rear edge of the pivot pin 15. If the ski pole is now rotated clockwise in the aft direction of the arrow f by pulling it rearwardly an opening torque is created which pivots the overcenter link out of its locked position. As soon as the link moves beyond the overcenter point the cooperative effects of the springs 18 and 25 snap the overcenter link into its open position. This movement is limited by the abutment 28 as can be seen from FIG. 2. An intermediate position of the opening movement is illustrated in FIG. 3.

The opening movement is damped by the frictional effects of the plate springs 29 while the tension in the springs 18 and 25 reduces during the opening movement. This reduction of the spring force is made clearer from FIG. 3 in which the clamp is shown in a more relaxed position by the dotted lines 18'. The abutment force at the abutments 28 is thereby limited to a reasonable value and, indeed, the damping by way of the links 12 can have a pronounced effect during the last stages of opening of the clamp before contact with the abutments occurs which allows damage to the binding to be effectively prevented.

Furthermore during the last stages of the opening movement of the binding i.e., from movement beyond the position shown in FIG. 3 the auxiliary spring 25 is effective to pivot the clamp 18 and the associated actuating part 19 rearwardly in a counter-clockwise sense so that the hooked end 23 is lifted from the undercut abutment 16 and moves to approximately the position shown in FIG. 2. At this stage the ski shoe can be moved without difficulty out of the binding.

Because in the open position the spacing of the auxiliary spring 25 from the rear edge of the top restraints 22 is very small the actuating part 19 can only rotate by a trivial amount once the ski shoe has been withdrawn before the auxiliary spring 25 engages the rear edges of the top restraints 22. In this condition the hooked end 23 is held so far from the base plate 31 that the ski shoe can be inserted once more into the binding without hindrance. If the ski shoe is once more inserted into the binding then as seen in FIG. 3 the tip 21 of the ski pole can be inserted into the recess 27 and the initial effect of pressing on the ski pole is that the links adopt or remain generally in their position shown in FIG. 2 while the clamp 18 rotates in the clockwise direction about the axis 15 and the clamp 18 together with the actuating part 19 are caused to move pivotally in a clockwise direction about the axis of the pin 15 which brings the hooked end 23 once more into engagement with the undercut abutment 16. Stronger pressure on the ski pole results in a sufficient torque being generated to rotate the clamp about the transverse axis 14 in the direction of closure and finally the binding will snap into the closed position shown in FIG. 1 whereby the binding has once more been closed.

As can be seen in FIG. 1 the hooked end 23 bears not only on the abutment at the front end of the shoe but also on the rear edge of the toe restraint 22. This prevents the sole of the ski shoe being too strongly drawn into the tapered space between the side plates 11. The same effect can be achieved by providing an abutment (not shown) fixed to the binding of the ski and located in front of the thickened portion 32 of the sole of the ski shoe.

It is preferred, however, that the hooked end 23 does not contact either the top restraint 22 or some other part of the binding so that a tensile force is continuously exerted in the forward direction on the extension 17 of the sole of the ski shoe.

As can be seen exceptionally clearly from FIG. 1 the cross country ski binding in accordance with the invention allows a complete freedom of movement for the sole of the ski shoe in the region in which it leaves the top restraint 22.

It is also of advantage that pivotal movement of the binding in the direction of arrow f of FIG. 2 allows it to be reached from underneath so that it can readily be cleaned.

In accordance with a further feature of the invention a locking member can be associated with the overcenter link which will ensure with total security, even when the binding is used for racing, that the binding does not undesirably spring open of its own accord. The locking member can e.g. be so arranged that in the closed position of the binding the pin 15 is prevented from being lifted in an upward direction or such that relative movement between the links 12 and the clamp 18 is prevented.

FIG. 5 shows a simplified embodiment in which the auxiliary spring 25, the actuating part 19 and the friction device formed by the plate springs 29 are omitted. For the purpose of opening the binding a strap 119 is connected to the pivot pin 15 and may be pulled to produce the necessary movement. Furthermore an aperture 20' is provided in the spring clamp 18 adjacent the pivot pin 15 to which either the tip 21 or the end of the grip of a ski pole can be applied in order to close the binding by pressure in a downward direction or to open it by pivotal movement in the direction of the arrow f. In this manner a binding is provided which can be conveniently opened and closed by fore and aft movements of the ski pole. The opening procedure is especially straight forward because the skier only requires to pull the ski pole inserted into the opening 20' toward himself to enable the long lever-arm formed by the ski pole to advantageously and simply produce the necessary torque to open the binding.

It will be appreciated by those skilled in the art that modifications can be made to the teaching contained herein without departing from the scope of the appended claims.

What we claim is:

1. Cross country ski binding comprising:

fixed binding means for attachment of a ski boot to a ski, said fixed binding means having side plate means and top restraint means for forming a chamber that is open at at least one end for receiving and locating, in use, a front portion of a sole of a ski shoe;

clamp means for releasably securing a ski boot to said fixed binding means, said clamp means comprising an elastically resilient spring clamp having a hook-shaped ski shoe sole engaging formation at a first end;

link means for enabling displacement of said clamp means relative to said fixed binding means, said link means being pivotally connected at a first end to said fixed binding means for movement about a fixed pivot axis;

over center pivot axis means for interconnecting a second end of said clamp means with a second end of said link means forwardly of said chamber;

actuating means for engaging and releasing the clamp means by producing pivotal movement of the link means and clamp means about said fixed pivot axis between released and fully engaged positions by fore and aft pivotal movement of a ski pole engageable in said actuating means, said actuating means being associated with said spring clamp and comprising an aperture through a forward portion of said clamp means and sized for enabling insertion of a tip of a ski pole, said aperture having front and rear borders, the rear border being closer to said hook-shaped formation than said front border, and wherein said aperture is located, when said clamping means is in said fully engaged position, in general above said over center pivot axis, with the rear border of said aperture lying in general above a corresponding rear border of the over center pivot axis in a manner whereby an engaged tip of a ski pole contacting both said rear borders results in a position of the ski pole inclined in a slightly forward direction.

2. Cross country ski binding according to claim 1, wherein said actuating means is integral with said spring clamp.

3. Cross country ski binding according to claim 1, wherein an auxiliary spring is fastened to said spring clamp and has a free end adapted to bear on at least one of an upper part of a ski shoe and said fixed binding means, said auxiliary spring being under load when the binding is engaged and relaxed when, on release of the binding, said hook means of the clamp is disengaged.

4. Cross country ski binding according to claim 3, wherein said auxiliary spring comprises a leaf spring extending from the actuating means to said top restraint means.

5. Cross country ski binding according to claim 3, wherein said auxiliary spring extends beneath the spring clamp.

6. Cross country ski binding according to claim 5 and in which said auxiliary spring comprises a relatively weak spring whereby in its engaged position the forces generated by said auxiliary spring are solely sufficient to lift the relaxed clamp from its co-operating abutment.

7. Cross country ski binding according to claim 1, wherein said actuating means further comprises a recess for receiving a ski pole tip to produce, on the application of pressure to said ski pole, an engaging movement of said binding.

8. Cross country ski binding according to claim 7 and in which said recess is located between said over center pivot axis and said hook-shaped formation.

9. Cross country ski binding according to claim 7 and in which there is further provided abutment means co-operable with a relatively movable part of the binding to limit the range of release movement of the binding and in which said recess, in the release position of the binding, is fractionally displaced rearwardly from the said fixed pivot axis whereby on the application of progressively increasing pressure from the ski stick an initial closing torque is generated which results in engagement of said hook-shaped formation with a sole of a ski shoe and subsequently results in closing movement of said binding to said fully engaged position.

10. Cross country ski binding according to claim 1 wherein there is further provided abutment means co-operable with a relatively movable part of the binding to limit the range of release movement to a position corresponding to disengagement of said hook-shaped formation.

11. Cross country ski binding according to claim 10 and in which said abutment means co-operates with said link means.

12. Cross country ski binding according to claim 1, further comprising co-operable friction means between relatively movable parts of the binding for generating a frictional resistance to at least closing movement of the binding.

13. Cross country ski binding according to claim 12 and in which said friction means bears on said link means in the vicinity of the said fixed pivot axis.

14. Cross country ski binding according to claim 1 and in which said binding includes structure which in an engaged position of the binding is located at the front of the binding and defines a vertically disposed surface protecting said binding from unintentional release due to contact with snow or other objects.

15. Cross country ski binding according to claim 1, wherein said actuating means, said link means and said fixed pivot axis are constructed and arranged for causing movement of said actuating means to release the binding, at least to the extent that said hook-shaped formation no longer clamps an engaged ski shoe into the chamber to result in a rearwardly inclined position of a ski pole inserted in said aperture into said with said rear borders of said aperture and fixed pivot axis.

16. Cross country ski binding comprising:

fixed binding means for attachment of a ski boot to a ski, said fixed binding means having side plate means and top restraint means for forming a chamber that is open at at least one end for receiving and locating, in use, a front portion of a sole of a ski shoe;

clamp means for releasably securing a ski boot to said fixed binding means, said clamp means comprising an elastically resilient spring clamp having a hook-shaped ski shoe sole engaging formation at a first end;

link means for enabling displacement of said clamp means relative to said fixed binding means, said link means being pivotally connected at a first end to said fixed binding means for movement about a fixed pivot axis;

over center pivot axis means for interconnecting a second end of said clamp means with a second end of said link means forwardly of said chamber;

actuating means for engaging and releasing the clamp means by producing pivotal movement of the link means and clamp means about said fixed pivot axis between released and fully engaged positions by fore and aft pivotal movement of a ski pole engageable in said actuating means, said actuating means comprising an aperture sized to receive the tip of a ski pole, said aperture being provided in said spring clamp at a location in the vicinity of the over center pivot axis and forwardly of said chamber for enabling engaging and disengaging of said spring clamp with respect to a front portion of a ski boot sole received in said chamber.

17. Cross country ski binding according to claim 1 or 16, wherein the spring clamp comprises an at least partially curved and spring-wise extensible spring clamp.

18. Cross country ski binding according to claim 17, wherein the spring clamp comprises a leaf spring.

19. Cross country ski binding according to claim 16, wherein said actuating means is integral with said spring clamp.

20. Cross country ski binding according to claim 16, wherein said actuating means, said link means and said fixed pivot axis are constructed and arranged for causing movement of said actuating means to release the binding, at least to the extent that said hook-shaped formation no longer clamps an engaged ski shoe into the chamber, to result in a rearwardly inclined positioning of a ski pole inserted in said aperture into contact with rear borders of said aperture and fixed pivot axis.

21. Cross country ski binding according to claim 1 or 16 and in which said spring clamp has an unflexed length which in conjunction with the relative dimensions of other cooperating parts of the binding results in said spring clamp being substantially tensioned over practically the entire range of movement of the binding between engaged and released positions and is only relaxed over a narrow range of movement near to a fully released position.

22. Cross country ski binding according to claim 16 and in which said actuating means further comprises a strap attached to said over center pivot axis.

* * * * *